US010492263B2

(12) United States Patent
Miller et al.

(10) Patent No.: US 10,492,263 B2
(45) Date of Patent: Nov. 26, 2019

(54) DEVICES AND METHODS FOR LIGHTING REFLECTOR TO VISIBLY EMPHASIZE DIFFERENT LIGHTING CHARACTERISTICS OF MULTIPLE LIGHT GROUPS

(71) Applicant: ABL IP HOLDING LLC, Conyers, GA (US)

(72) Inventors: Joshua J. Miller, Highlands Ranch, CO (US); Christopher J. Sorensen, Denver, CO (US); Christopher D. Slaughter, Littleton, CO (US); Carl T. Gould, Golden, CO (US); Peter K. Nelson, Denver, CO (US)

(73) Assignee: ABL IP HOLDING LLC, Conyers, GA (US)

( * ) Notice: Subject to any disclaimer, the term of this patent is extended or adjusted under 35 U.S.C. 154(b) by 0 days.

(21) Appl. No.: 15/723,800

(22) Filed: Oct. 3, 2017

(65) Prior Publication Data

US 2019/0104577 A1 Apr. 4, 2019

(51) Int. Cl.

| | |
|---|---|
| ***F21V 7/00*** | (2006.01) |
| ***H05B 33/08*** | (2006.01) |
| ***F21V 7/04*** | (2006.01) |
| ***F21V 23/00*** | (2015.01) |
| *F21Y 115/10* | (2016.01) |

(52) U.S. Cl.

CPC ..... *H05B 33/086* (2013.01); *F21V 7/0025* (2013.01); *F21V 7/04* (2013.01); *F21V 23/003* (2013.01); *H05B 33/0842* (2013.01); *H05B 33/0845* (2013.01); *F21Y 2115/10* (2016.08)

(58) Field of Classification Search

CPC .... F21V 7/0025; F21V 7/0033; F21V 7/0083; F21V 7/0091; F21V 7/04; F21V 23/003; H05B 33/02; H05B 33/08; H05B 33/0803; H05B 33/0845; H05B 33/086

See application file for complete search history.

(56) References Cited

U.S. PATENT DOCUMENTS

| | | | | |
|---|---|---|---|---|
| 6,234,648 | B1 * | 5/2001 | Borner | C09K 11/584 362/235 |
| 6,985,163 | B2 * | 1/2006 | Riddle | G01J 1/08 345/591 |
| 8,829,822 | B2 | 9/2014 | Laski et al. | |
| 9,618,184 | B2 * | 4/2017 | Buchholz | F21V 7/0066 |
| 9,648,673 | B2 * | 5/2017 | Pickard | H05B 33/0803 |

(Continued)

*Primary Examiner* — Jason Crawford

(74) *Attorney, Agent, or Firm* — RatnerPrestia

(57) ABSTRACT

Lighting devices, systems, and methods are disclosed. One lighting device includes a reflector, first and second groups of light emitters, and a controller. The reflector defines a reflective cavity having an opening and an interior surface including first and second features adapted to reflect light in different manners. The first and second groups of light emitters are positioned to emit light through the reflective cavity toward the first and second features, respectively. The controller is coupled to the first and second groups of light emitters, and is configured to control the first group of emitters to emit light having a first value of a characteristic of emitted light, and control the second group of emitters to emit light having a second value of the characteristic of emitted light different from the first value.

30 Claims, 7 Drawing Sheets

(56) References Cited

U.S. PATENT DOCUMENTS

2003/0016536 A1* 1/2003 Lin ..... F21S 9/022 362/249.02
2007/0138978 A1* 6/2007 Rains, Jr. ..... F21S 2/00 315/291
2009/0002986 A1* 1/2009 Medendorp, Jr. ..... F21S 8/06 362/247
2009/0296368 A1* 12/2009 Ramer ..... F21V 14/003 362/84
2010/0172152 A1* 7/2010 Boonekamp ..... F21V 7/0008 362/609
2010/0259918 A1* 10/2010 Rains, Jr. ..... F21V 7/0025 362/84
2010/0277316 A1* 11/2010 Schlangen ..... A61M 21/00 340/540
2012/0112661 A1* 5/2012 van de Ven ..... H05B 33/0803 315/294
2012/0134133 A1* 5/2012 Kang ..... F21V 3/00 362/84
2012/0300452 A1* 11/2012 Harbers ..... H05B 33/0803 362/231
2013/0223079 A1* 8/2013 Jung ..... F21S 8/02 362/297
2013/0294058 A1* 11/2013 Lou ..... F21V 7/005 362/217.05
2014/0063779 A1* 3/2014 Bradford ..... F21V 23/0442 362/84
2014/0232288 A1* 8/2014 Brandes ..... H05B 33/0803 315/250
2014/0254171 A1* 9/2014 Greiner ..... F21V 7/0091 362/308
2014/0328045 A1* 11/2014 Valteau ..... A61B 90/30 362/33
2015/0247623 A1* 9/2015 Hikmet ..... F21K 9/64 362/84
2015/0289344 A1 10/2015 Leadford et al.
2016/0025273 A1* 1/2016 van de Ven ..... F21K 9/64 362/293
2016/0123564 A1* 5/2016 Quilici ..... F21V 23/003 362/233
2017/0219170 A1* 8/2017 Petluri ..... F21K 9/62
2018/0267223 A1* 9/2018 Rodgers ..... G02B 5/0231

* cited by examiner

DEVICES AND METHODS FOR LIGHTING REFLECTOR TO VISIBLY EMPHASIZE DIFFERENT LIGHTING CHARACTERISTICS OF MULTIPLE LIGHT GROUPS

TECHNICAL FIELD

The disclosed subject matter relates to lighting devices, and to configurations and/or operations thereof, whereby a lighting device having groups of light emitters and a reflector are controllable to produce lighting configurations in which light having different values of lighting characteristics is visibly reflected by the reflector.

BACKGROUND

Electrically powered artificial lighting has become ubiquitous in modern society. Electrical lighting devices or luminaires, such as light fixtures or lamps, are commonly deployed, for example, in homes, buildings of commercial and other enterprise establishments, as well as in various outdoor settings.

Multiple lighting devices are often linked in their operation in order to provide general illumination to an entire region, such as an entire floor of an office or commercial establishment. In such traditional lighting systems, these lighting devices often perform no function in addition to the general illumination of the region to which they are directed. This general illumination can be turned on or off, and often can be adjusted up or dimmed down.

Lighting devices may use multiple different colors of light emitters, such as light emitting diode (LED) type emitters of different color temperatures of white lighting and/or different saturated or primary colors (e.g. red (R), green (G), blue (B)) or combinations thereof. These lighting devices may enable a user to adjust the intensity of certain light emitters in order to adjust a combined spectral output of the resulting illumination, such as correlated color temperature (CCT). Such lighting devices are operated to produce white light of one or more selectable CCTs for general illumination.

In order to combine light from multiple different colors of light emitters, some lighting devices may include one or more diffuse reflectors. These reflectors may include concave, highly reflective interior surfaces which diffuse light from different emitters to produce white light, and reflect this white light toward an area to be illuminated.

Nonetheless, there may be room for further improvement in the use of lighting devices to produce white light while also creating visual interest for an observer or conveying to an observer a dynamic or tunable functionality of the lighting device.

SUMMARY

The concepts disclosed herein improve over the art by providing lighting devices suitable for producing white light for general illumination while also creating visual interest for an observer or conveying to an observer a dynamic or tunable functionality of the lighting device through the creation of an observable pattern of light reflection.

One lighting device includes a reflector, first and second groups of light emitters, and a controller. The reflector defines a reflective cavity having an opening. An interior surface of the reflective cavity includes at least one first feature adapted to reflect light in a first manner, and at least one second feature adapted to reflect light in a second manner different from the first manner. The first group of controllable light emitters is positioned to emit light through the reflective cavity toward the at least one first feature. The second group of controllable light emitters is positioned to emit light through the reflective cavity toward the at least one second feature. The second group of light emitters may be independently controllable relative to the first group of light emitters. The controller is coupled to the first and second groups of light emitters. The controller is configured to control the first group of emitters to emit light having a first value of a characteristic of emitted light reflected from the at least one first feature and visible through the opening of the reflective cavity. The controller is also configured to control the second group of emitters to emit light having a second value of the characteristic of emitted light reflected from the at least one second feature and visible through the opening of the reflective cavity. The second value is different from the first value.

Another lighting device includes a reflector, first and second groups of light emitters, and a controller. The reflector defines a reflective cavity having an interior surface and an opening. The first group of controllable light emitters is positioned to emit light through the reflective cavity toward a first portion of the interior surface. The second group of controllable light emitters is positioned to emit light through the reflective cavity toward a second portion of the interior surface separate different from the first portion. The second group of light emitters may be independently controllable relative to the first group of light emitters. The controller is coupled to the first and second groups of light emitters. The controller is configured to control the first group of emitters to emit light having a first value of a spectral characteristic of emitted light reflected from the first portion of the interior surface and visible through the opening of the reflective cavity. The controller is also configured to control the second group of emitters to emit light having a second value of the spectral characteristic of emitted light reflected from the second portion of the interior surface and visible through the opening of the reflective cavity. The second value is different from the first value. The reflected light from the first group is visibly distinguishable to an observer from the reflected light from the second group.

The examples discussed below also encompass methods of operation or control of lighting devices. One method includes emitting light from a first group of controllable light emitters through a reflective cavity of a reflector, an interior surface of the reflective cavity comprising at least one first feature adapted to reflect light in a first manner, and at least one second feature adapted to reflect light in a second manner different from the first manner, the first group emitting light toward the at least one first feature; emitting light from a second group of controllable light emitters through the reflective cavity toward the at least one second feature, the second group of light emitters being independently controllable relative to the first group of light emitters; controlling the first group of emitters to emit light having a first value of a characteristic of emitted light reflected from the at least one first feature and visible through an opening of the reflective cavity; and controlling the second group of emitters to emit light having a second value of the characteristic of emitted light reflected from the at least one second feature and visible through the opening of the reflective cavity, the second value being different from the first value.

Another method includes emitting light from a first group of controllable light emitters toward a first portion of an interior surface of a reflective cavity of a reflector; emitting light from a second group of controllable light emitters toward a second portion of the interior surface of the reflective cavity, the second portion of the interior surface separate from the first portion; controlling the first group of emitters to emit light having a first value of a spectral characteristic of emitted light reflected from the first portion of the interior surface and visible through the opening of the reflective cavity; and controlling the second group of emitters to emit light having a second value of the spectral characteristic of emitted light reflected from the second portion of the interior surface and visible through the opening of the reflective cavity, the second value being different from the first value.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1A:
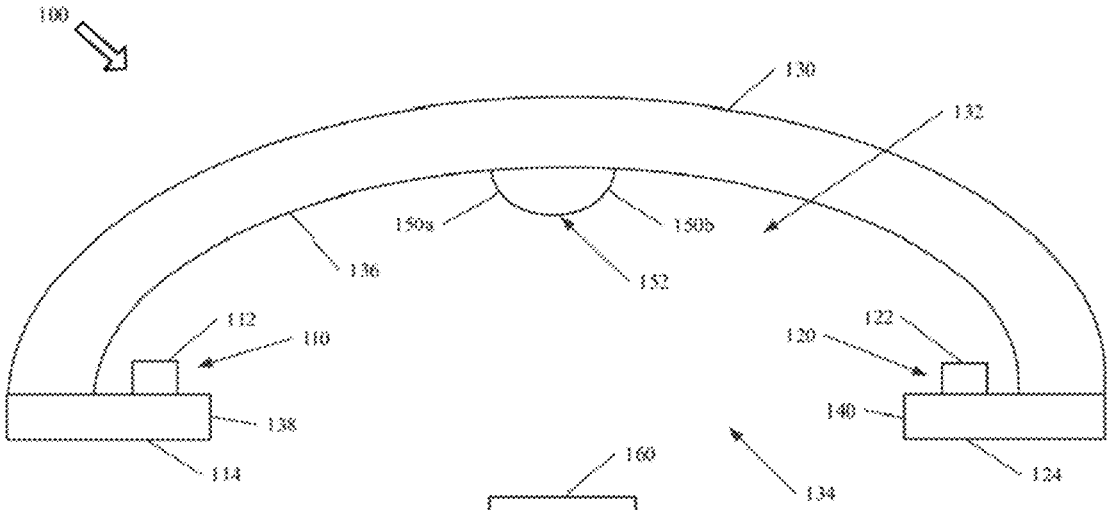
FIG. 1A is cross-sectional side view of an example of a lighting device.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The concepts disclosed herein improve over the art by providing lighting devices that provide uniform, functional white light illumination while also creating visual interest in the lighting device, or conveying to an observer a dynamic or tunable functionality of the lighting device where such functionality is present. The visual interest or information on functionality may be created through a pattern of reflection of light from sources which emit light having visibly different characteristics, e.g., different spectral characteristics or different intensities. This pattern of light reflection is visible to an observer looking at the reflector of the lighting device, but may not be apparent or observable from the combined white light emitted by the lighting device for illuminating an area or objects in the vicinity of the lighting device.

The detailed description below and the accompanying drawings disclose examples of lighting devices, and systems and methods employing such lighting devices. In one such example, a lighting device may include a reflector, multiple groups of light emitters, and a controller. The reflector includes a reflective cavity having an opening through which light may be reflected to illuminate an area. An interior surface of the reflector may include separate portions or features which are adapted to reflect light in different manners. The groups of light emitters are configured to emit light through the reflective cavity toward the separate portions or features. The controller controls the groups of light emitters to emit light having different values of a characteristic of emitted light, such as chromaticity, correlated color temperature, or intensity. This emitted light may be combined and reflected by the reflector through the opening in the reflective cavity in order to produce a white light having a predetermined intensity or spectral characteristic for illuminating an area.

Nonetheless, the reflection of the light from the different groups off of the separate portions or features of the reflector results in an observable pattern of light reflection on the interior surface of the reflector, in which the light from one group of light emitters is visibly distinguishable to an observer from the light from another group of light emitters. Such visible distinction may include the ability of an observer to identify that portions or features of the reflector are reflecting light having a particular color or chromaticity or CCT relative to other light reflected from the reflector or have a different intensity relative to other light reflected from the reflector. This observable pattern may create visual interest in the light device, or help to illustrate to an observer a dynamic or tunable functionality of the lighting device, where such functionality is present.

The elements of the lighting device may be combined together in one relatively integral unit, e.g. in a luminaire. Alternatively, the elements of the device may be somewhat separate from each other, e.g. with the controller provided separately from the reflector and the groups of light emitters.

The groups of light emitters may be provided in separate areas around a periphery of the opening in the reflective cavity. In one example, the reflective cavity may be somewhat rectilinear, e.g. having a rectangular shape, with a different group of light emitters provided along each edge of the cavity.

The interior surface of the reflector may include portions adapted to reflect light differently from one another in order to promote creation of the observable pattern of light reflection. These features may in some examples be formed as projections or indents which reflect light from the groups of light emitters in different directions. In other examples, these features may have different reflectance or diffusion properties.

Examples discussed below also encompass systems and methods for operating or controlling lighting devices. In these examples, one or more of the groups of lighting devices may be controlled to have a varying spectral characteristic and/or intensity over time, in order to further illustrate the dynamic or tunable functionality of the lighting device. While adjusting the intensity, the controller may further control the groups of light emitters to maintain a predetermined level of illumination or light intensity emitted by all groups of light emitters, e.g., within a predetermined range of a set intensity, in order to prevent disruption of the primary function of illumination provided by the lighting device. The control may also maintain a predetermined color characteristic within a range of a set color characteristic (e.g. a coordinated color temperature and/or color rendering index within ±10% of set value(s)) of the combined light at a distance from the output of the lighting device.

Examples discussed below and shown in the drawings improve over the art by achieving additional features beyond just the illumination of an area with white light. These examples may visually provide information to an observer about the spectral characteristics of light emitted by the lighting device, or about changes in those spectral characteristics over time. These examples may further enable the lighting device to convey an impression of change in geometric shape, size, or orientation of the lighting device over time. The observable patterns of light reflection created by the examples may be used to convey specific information or impressions to an observer in the illuminated area.

The lighting devices under consideration here may be applied to any indoor or outdoor region or space that requires at least some illumination. The lighting equipment involved here may provide the main illumination component in the space, rather than ancillary light output as might be provided by a display, or by or in association with a sound system, or the like. As such, the illumination from one or more of the fixtures, lamps, luminaires, daylighting equipment or other types of lighting devices is the main illumination that supports the purpose of the space, for example, the lighting that provides illumination sufficient to allow occupants in the space to perform the normally expected task or tasks associated with the planned usage of the space. Herein, such lighting is referred to as "general" lighting or "general" illumination.

The term "lighting device" as used herein is intended to encompass essentially any type of device that processes, generates, or supplies light, for example, for general illumination of a space intended for use of or occupancy or observation, typically by a living organism that can take advantage of or be affected in some desired manner by the light emitted from the device. However, a lighting device may provide light for use by automated equipment, such as sensors/monitors, robots, etc. that may occupy or observe the illuminated space, instead of or in addition to light provided for an organism. It is also possible that one or more lighting devices in or on a particular premises have other lighting purposes, such as signage for an entrance or to indicate an exit. Of course, the lighting devices may be configured for still other purposes, e.g. to benefit human or non-human organisms or to repel or even impair certain organisms or individuals. In most examples, the lighting device(s) illuminate a space or area of a premises to a level useful for a human in or passing through the space, e.g. regular illumination of a room or corridor in a building or of an outdoor space such as a street, sidewalk, parking lot or performance venue. The actual source of light in or supplying the light for a lighting device may be any type of light emitting, collecting or directing arrangement.

The term "coupled" as used herein refers to any logical, physical, optical or electrical connection, link or the like by which forces, energy, signals or other actions produced by one system element are imparted to another "coupled" element. Unless described otherwise, coupled elements or devices are not necessarily directly connected to one another and may be separated by intermediate components, elements or communication media that may modify, manipulate or carry the signals. The "coupled" term may apply to either one or both of optical coupling and electrical coupling. For example, a light emitter or sensor may be optically coupled to a lens or the like, whereas a processor or the like may be coupled to control and/or exchange instructions or data with a light emitter or sensor or with other elements of a device or system via electrical connections, optical connections, electromagnetic communications, etc.

Figure 1B:
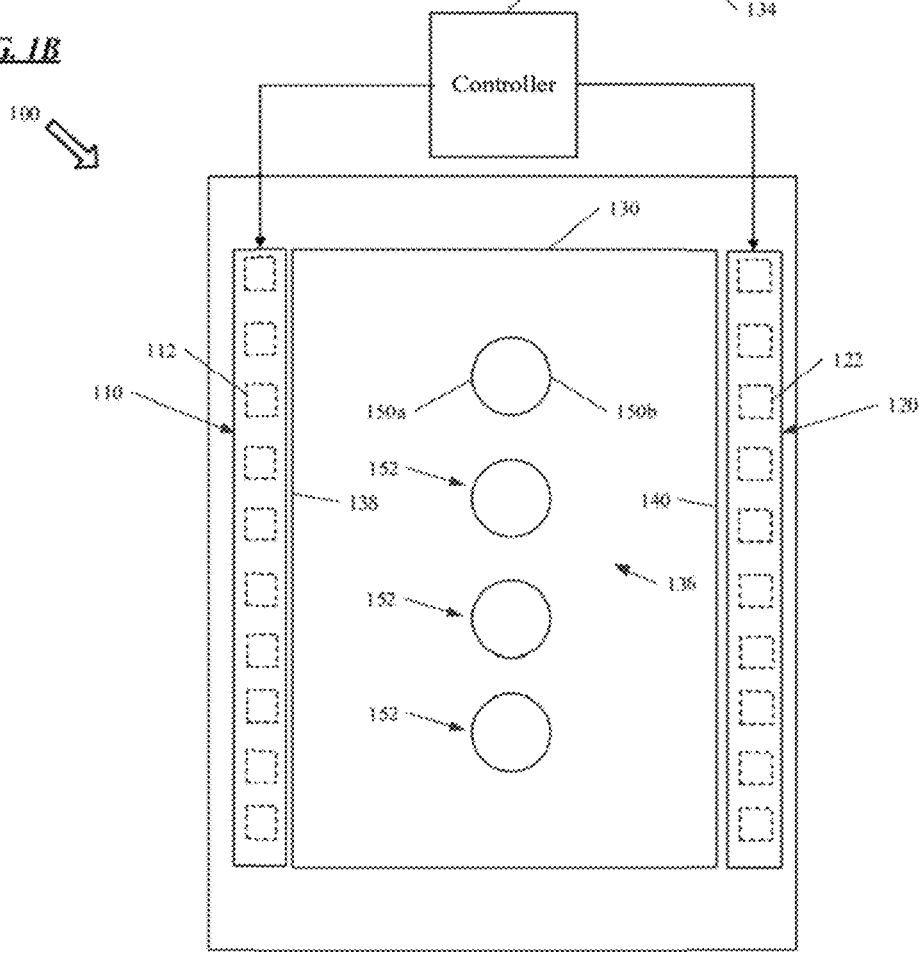
FIG. 1B is a plan view (e.g. as if viewed from a space to be illuminated) of the lighting device of FIG. 1A.

Reference now is made in detail to the examples illustrated in the accompanying drawings and discussed below. FIGS. 1A and 1B illustrate an example of a lighting device 100. As a general overview, lighting device 100 may include a first group 110 of controllable light emitters, a second group 120 of controllable light emitters, a reflector 130. The emitters of the lighting device 100 are coupled to a controller 160, which may be integrated with the device 100 or may be implemented/located separately. Additional details regarding lighting device 100 are set forth below.

Groups 110 and 120 each include one or more light emitters 112 and 122, respectively, which output light. Groups 110 and 120 may be integrated into lighting device 100, such as in a luminaire, or may be separate from lighting device 100. Virtually any source of light may be used for light emitters 112 and 122. If lighting device 100 is a luminaire, groups 110 and 120 may be configured to emit light of intensity and other characteristics appropriate for artificial general illumination. A variety of suitable light generation sources are indicated below.

Suitable light generation sources for use as light emitters 112 and 122 include various conventional lamps, such as incandescent, fluorescent or halide lamps; one or more light emitting diodes (LEDs) of various types, such as planar LEDs, micro LEDs, micro organic LEDs, LEDs on gallium nitride (GaN) substrates, micro nanowire or nanorod LEDs, photo pumped quantum dot (QD) LEDs, micro plasmonic LED, micro resonant-cavity (RC) LEDs, and micro photonic crystal LEDs; as well as other sources such as micro super luminescent Diodes (SLD) and micro laser diodes. Of course, these light generation technologies are given by way of non-limiting examples, and other light generation technologies may be used to implement the light emitters 112 and 122.

Groups 110 and 120 may include a single emitter to generate light, or may combine light from some number of emitters to generate the light. A lamp or 'light bulb' is an example of a single source; an array of LEDs is an example of multiple light emitters. An LED light engine may provide a single output for a single source but typically combines light from multiple LED type emitters within the single engine.

Groups 110 and 120 may be controllable to emit light having different values of one or more characteristics of emitted light. These characteristics may include spectral characteristics, for example, chromaticity or correlated color temperature (CCT), and/or may include non-spectral characteristics, for example, intensity or diffusion. Groups 110 and 120 may achieve these different values of light emission characteristics by way of being independently controlled by controller 160, and/or by including different numbers, types, or concentrations of light emitters 112 and 122.

In one example, first group 110 of light emitters 112 includes multiple light emitting diodes which are controlled to emit light that, when combined, produces white light with a cool blue tint corresponding to a relatively high CCT (e.g., 4,000K to 5,000K), while group 120 of light emitters 122 includes multiple light emitting diodes which are controlled to emit light that, when combined, produces white light with a warm yellow, orange, and/or red tint corresponding to a relatively low CCT (e.g., 2,700K-3,500K). In another example, first group 110 of light emitters 112 includes multiple light emitting diodes which are controlled to emit light which, when combined, has a first relatively high intensity and second group 120 of light emitters 122 includes multiple light emitting diodes which are controlled to emit light which, when combined, has a second relatively low intensity. The above examples of light emitter arrangements and control in groups 110 and 120 are non-limiting examples, and other arrangements and/or controls of groups 110 and 120 may be used.

While two light groups 110 and 120 are described herein, it will be apparent that any number of groups of light emitters may be selected. For example, rectangular lighting devices may include four (or any multiple of four) light groups positioned on respective edges of the lighting device. Other arrangements of light emitter groups may be selected based on the desired pattern of light reflection. Also, although shown separately (e.g. on opposite sides of the rectangular example device), the emitters of the groups may be somewhat or completely disbursed amongst each other.

Reflector 130 reflects light emitted by the light emitters of groups 110 and 120. Reflector 130 defines a reflective cavity 132 having an opening 134 positioned at a lower edge. An interior surface 136 of reflector 130 includes a diffuse reflective material suitable for reflecting light from light groups 110 and 120. Light groups 110 and 120 are positioned to emit like through reflective cavity 132 toward interior surface 136, which reflects the light outward through opening 134 to illuminate the area in the vicinity of lighting device 100. Groups 110 and 120 may be oriented to emit light directly through cavity 132, or in some examples, groups 110 and 120 may be provided with optical elements, such as lenses, prisms, mirrors, gratings, or other well-known light directing elements, to direct light from light emitters 112 and 122 through cavity 132.

As shown in FIG. 1A, reflector 130 may define a concave, hemi- or semi-cylindrical cavity to increase the amount of light which is reflected from groups 110 and 120 through opening 134 for illumination. Cavity 132 of reflector 130 is not limited to being cylindrical, but may include other shapes, or may include arrays of shapes, such as side-by-side semi-cylinders.

Figure 2A:
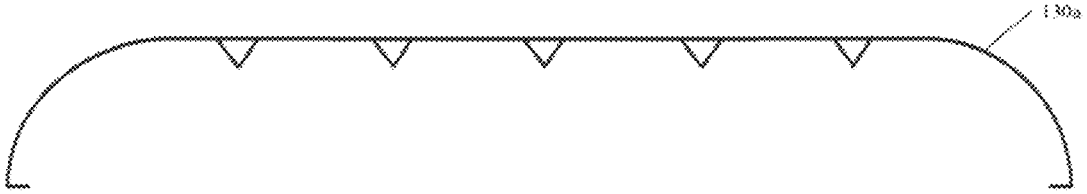
FIGS. 2A-2D are views of examples of different reflectors of lighting devices.
Figure 2B:
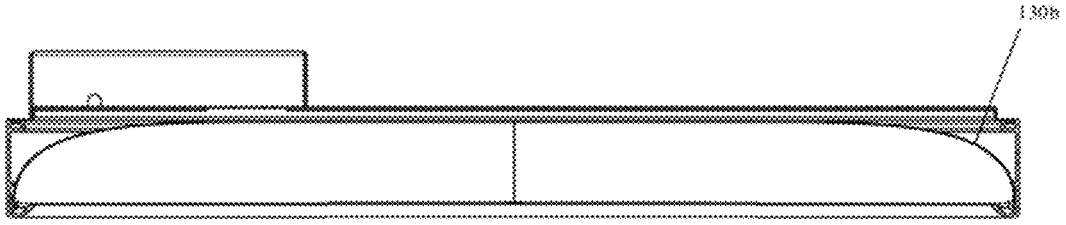
Figure 2C:
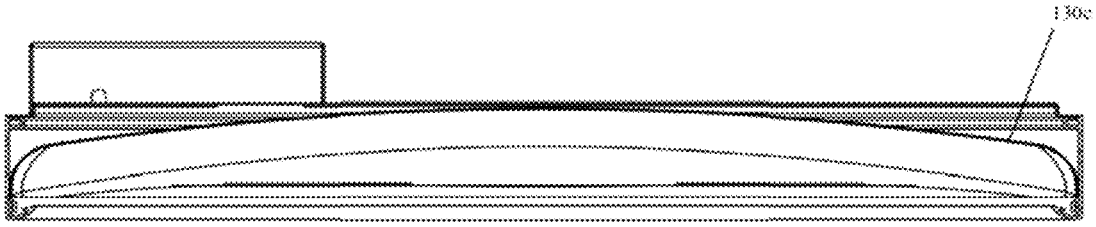
Figure 2D:
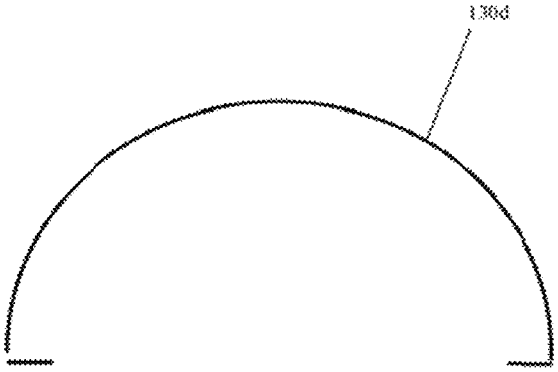
Figure 3A:
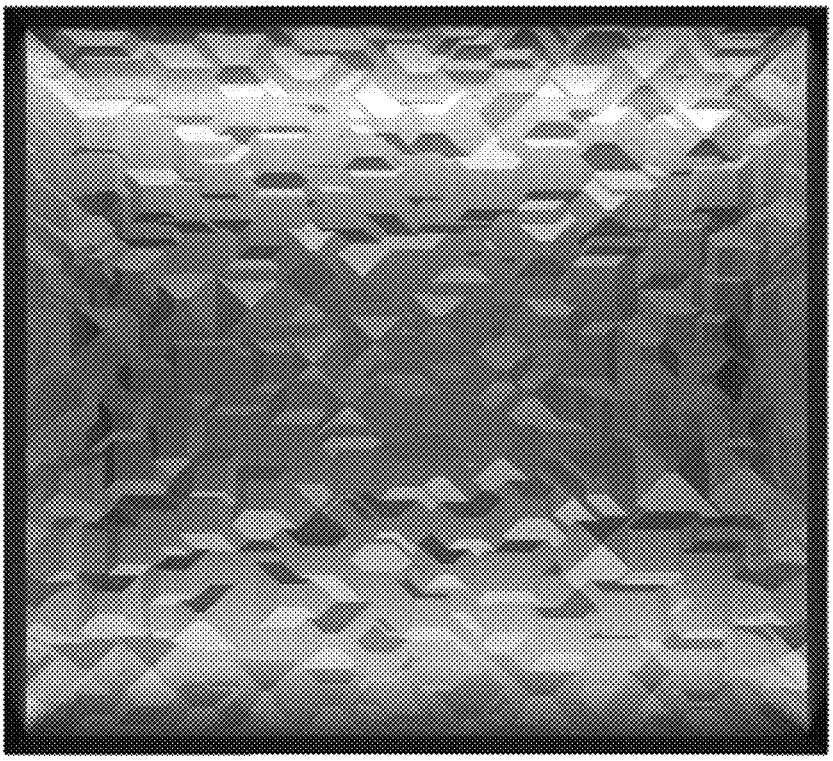
FIGS. 3A-3E are images of examples of different features of reflectors for reflecting light in different manners.
Figure 3B:
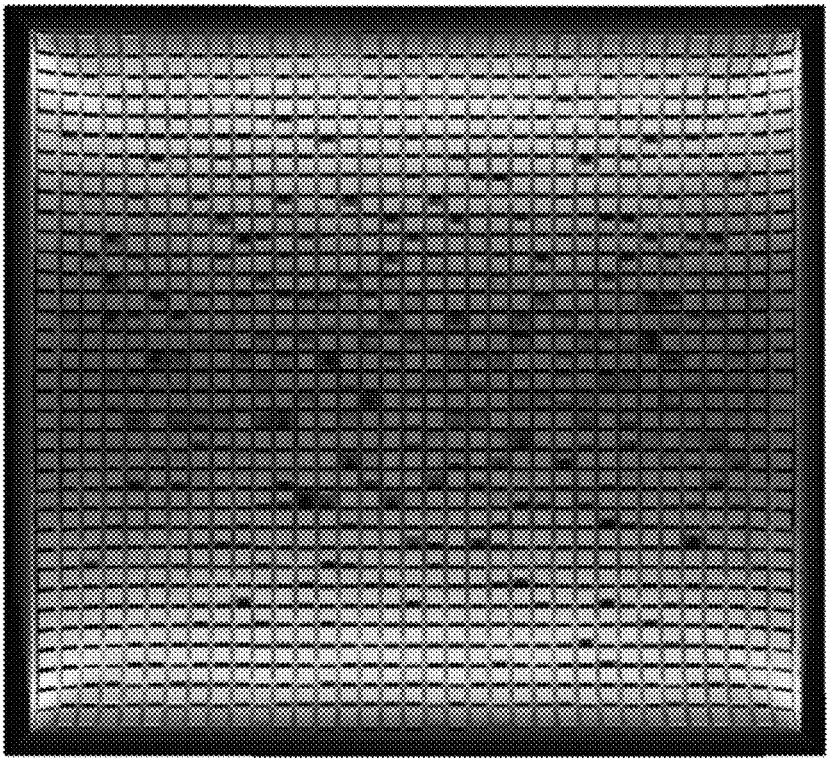
Figure 3C:
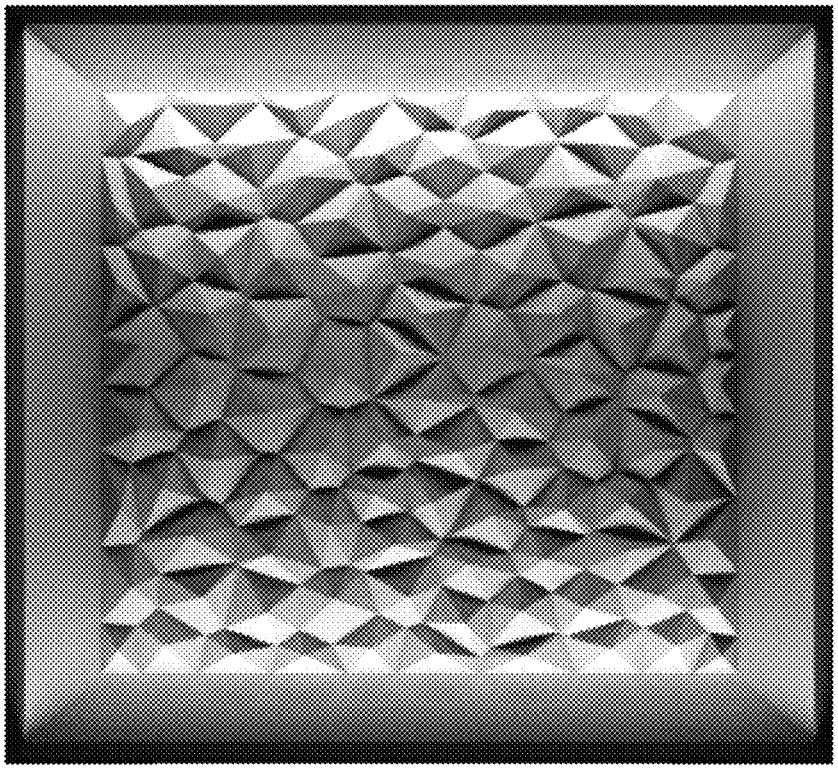
Figure 3D:
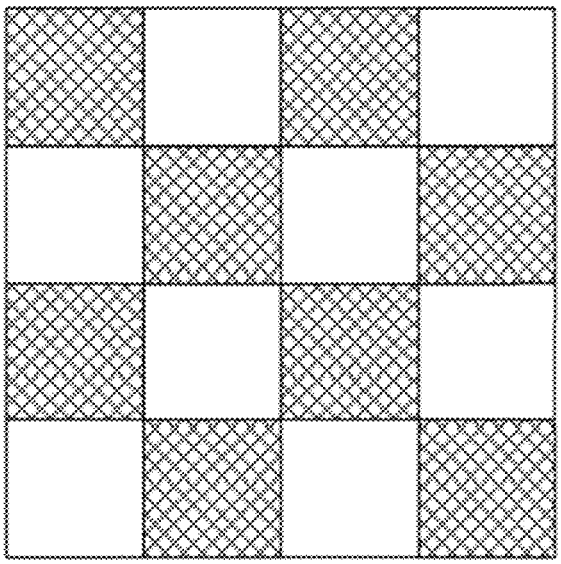
Figure 3E:
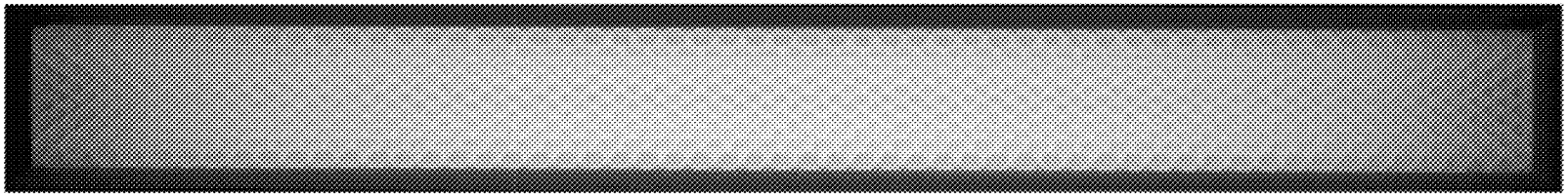

FIGS. 2A-2D illustrate additional examples of possible shapes for the cavities of reflectors of lighting device 100. As shown in FIG. 2A, reflector 130*a* may have generally curved, elliptical, or semi-circular sidewalls which extend upward to a flat ceiling. A set of tetrahedral or pyramidal features may be formed on the interior surface of reflector 130*a*. As shown in FIG. 2B, reflector 130*b* may have generally curved, elliptical, or parabolic sidewalls which extend upward to a flat ceiling. As shown in FIG. 2C, reflector 130*c* may have generally curved, elliptical, or semi-circular sidewalls which extend upward to a pair of sloping ceiling portions, which slope upwardly toward a central region of reflector 130*c*. These upward sloping portions may meet at a vertex or at a curved region, as shown in FIG. 2C. As shown in FIG. 2D, reflector 130*d* may have a curved, elliptical, or semicircular shape extending from one edge to an opposite edge. It will be understood that the above shapes are provided for the purpose of illustration and are not limiting.

As shown in FIG. 1A, groups 110 and 120 of light emitters may be positioned within cavity 132. Alternatively, groups 110 and 120 of light emitters may be positioned outside of cavity 132, and configured to emit light through opening 134 into cavity 132.

As shown in FIG. 1B, reflector 130 may define an opening 134 having a rectilinear shape. Opening 134 of reflector 130 is not limited to being rectilinear, but may have any shape or size selected in accordance with the desired function and illumination provided by lighting device 100. Lighting device 100 is itself not restricted in size. For example, lighting device 100 may be of a standard size, e.g., 2-feet by 2-feet (2×2), 2-feet by 4-feet (2×4), or the like. Multiple lighting devices 100 may be arranged like tiles for larger area coverage. Alternatively, lighting device 100 may be a larger area device that covers a wall, a part of a wall, part of a ceiling, an entire ceiling, or some combination of portions or all of a ceiling and wall.

As shown in FIG. 1B, groups 110 and 120 of light emitters may be positioned along the periphery of opening 134 of reflector 130. To accentuate the observable pattern of light reflection created by reflector 130, groups 110 and 120 may be positioned separately along the periphery of opening 134. In such positioning, groups 110 and 120 emit light toward reflector 130 from different directions, which may visually emphasize differences in the characteristics of light emitted by groups 110 and 120.

For one example, group 110 of light emitters 112 may be positioned along a first portion of the periphery of opening 134, and group 120 of light emitters 122 may be positioned along a second portion of the periphery of opening 134 separate from the first portion. In the example of FIG. 1B, in which opening 134 is rectilinear, opening 134 includes opposed edges 138 and 140. In this example, group 110 of light emitters 112 is positioned along edge 138, and group 120 of light emitters 122 is positioned along edge 140.

Groups 110 and 120 may be supported or bounded on a lower or outer side by a reflective or absorptive strip or housing. Such structures may be provided to prevent light from groups 110 or 120 from exiting cavity 132 without reflecting off of reflector 130, and/or to maximize the amount of light from groups 110 and 120 which is directed through cavity 132 to be reflected by reflector 130.

In one example, groups 110 and 120 are mounted on respective supports 114 and 124, as shown in FIG. 1A. While light emitters 112 and 122 are illustrated in FIG. 1A as facing in a vertical direction, it will be understood that light emitters may be oriented in any desired direction, e.g. vertically, horizontally, obliquely, etc., which allows a substantial portion of the light emitted to be transmitted through or redirected into cavity 132.

Reflector 130 may be formed by known thermoforming or vacuum forming processes. Reflector 130 may be formed from a material having a high reflectance (e.g., having a reflectance of 85% or more, 90% or more, 95% or more, or 98% or more), or may be formed from a substrate which is coated with a material having such a high reflectance. The reflective material of reflector 130 may further be a diffuse reflective material. Suitable materials for forming reflector 130 will be known from this description.

Reflector 130 may include features 150 formed on its interior surface 136 which are adapted to receive and reflect light from groups 110 and 120 in various different manners. In one example, reflector 130 includes at least one first feature 150*a* which is adapted to reflect light in a first manner, and at least one second feature 150*b* which is adapted to reflect light in a second manner different from the first manner. In this example, group 110 of light emitters 112 emits light through cavity 132 toward first feature(s) 150*a*, which reflect(s) the light from group 110, in the first manner, and group 120 of light emitters 122 emits light through cavity 132 toward second feature(s) 150*b*, which reflect(s) the light from group 120 in the second manner. Examples of different types of reflective features 150, as well as different manners in which features 150 may reflect light, are set forth below.

In some examples, features 150*a* and 150*b* reflect light in different manners by reflecting different amounts of light, e.g., due to their positioning and/or orientation relative to light groups 110 and 120. An observable pattern of light reflection may be created due to the reflective features reflecting different amounts of light. Features 150*a* and/or 150*b* may reflect different amounts of light due to being positioned at different relative distances from respective light groups, or due to having different orientations relative to respective light groups. For one example, feature 150*a* may be positioned closer to light group 110 than feature 150*b*. For another example, feature 150*a* may be oriented with its surface facing more toward light group 110 as compared with feature 150*b*. In each example, more light from light group 110 would impact the surface of feature 150*a* than feature 150*b*, and as a result, more light from light group 110 would be reflected from feature 150*a* than feature 150*b*. A desired observable pattern of light reflection may be created by selecting the position and orientation of features 150*a* and 150*b* based on which light groups are desired to be reflected more strongly by which features.

In some examples, features 150*a* and 150*b* are adapted to reflect light in different directions. In these examples, the light from first group 110 may be reflected in a first direction by first feature(s) 150*a*, and the light from second group 120 may be reflected in a second direction different from the first direction by second feature(s) 150*b*. The differences in directions of reflections between feature(s) 150*a* and 150(*b*) may be defined, for example, by differences in angles between a centerline of incident and reflected light from respective light groups 110 and 120. The angles of reflection may have different magnitudes or different directions/polarities. The different angles may be measured relative to the origination of the light, or may be different absolute angles. Features which reflect light in different directions may be formed by portions of interior surface 136 which face in different directions, or may be formed by distinct structures formed on interior surface 136.

In a particular example, interior surface 136 of reflector 130 includes one or more projections 152 which project from interior surface 136 into cavity 132. Such projections 152 may have a distinct number of side surfaces, or an elliptical or cylindrical side surface, which face toward the groups 110 and 120 of light emitters positioned along the periphery of opening 134. In this example, first features 150*a* may be formed as a first side of projections 152 which faces toward group 110 of light emitters 112, and second features 150*b* may be formed as a second side of projections 152 which faces toward group 120 of light emitters 122.

The number, shape, size, and arrangement of projections 152 is given by way of non-limiting example. For examples, projections 152 may be hemi- or semi-spherical, hemi- or semi-cylindrical, or faceted, such as tetrahedral or pyramidal. Projections 152 may have three, four, five, six, seven, eight, or any number of surfaces. It will be understood that any characteristics of projections 152, including their number, arrangement, shape, size, or concentration, may be selected in accordance with the desired function and illumination provided by lighting device 100, as well as the desired observable pattern of light reflection to be viewed by the observer. For example, projections 152 may be arranged in a pattern on interior surface 136, e.g., in an organized and repeating fashion such as in an array of projections. Alternatively, projections 152 may be arranged in a disorganized fashion on interior surface 136, e.g., with no discernible repetition or regularity, or seemingly at random. FIGS. 3A-3E set forth additional examples of possible shapes, sizes, and arrangements of reflective projections for the interior surfaces of reflectors of lighting device 100.

While the above examples describe projections which form features for reflecting light in different manners, it will be understood that such features may be formed instead by indents in the interior surface 136 of cavity 132. Such indents may be provided in substantially the same number, size, and arrangement as projections 152, and may have substantially the same (but inverted) shape as projections 152. Reflector 130 is not limited to including either projections or indents, but may include a combination of both, as desired.

In some examples, features 150*a* and 150*b* have different reflectances. In these examples, a first amount of the light from first group 110 may be reflected by first feature(s) 150*a*, and a second, different amount of the light from second group 120 may be reflected by second feature(s) 150*b*. Features with different reflectances may be formed by portions of interior surface 136 with different textures which affect the amount of reflectance, or with different coatings of reflective material. Such features may be formed during manufacture of reflector 130, e.g., by different textured surfaces on a mold, or by coating reflector 130 with different materials during or following manufacture of reflector 130.

In some examples, features 150*a* and 150*b* are adapted to reflect light with different amounts of diffusion, e.g., ranging from fully specular to a desired degree of diffusion. In these examples, light from first group 110 may be reflected by first feature(s) 150*a* with a first amount of diffusion, and light from second group 120 may be reflected by second feature(s) 150*b* with a second, different amount of diffusion. Like the reflectance features, features with different diffusion may be formed by portions of interior surface 136 with different textures which affect the amount of reflectance, or with different coatings of reflective material.

It will be understood that reflector 130 is not limited to having only a single type of feature 150, but may include different types or combinations of features selected in order to create a desired pattern of light reflection from reflector 130.

Reflector 130 need not include features 150 in order to create an observable pattern of light reflection in which light from groups 110 and 120 is visibly distinguishable to an observer. In other examples, interior surface 136 of reflector 130 may include separate portions or regions which create a desired observable pattern of light reflection. Interior surface 136 may receive light from both of groups 110 and 120. However, separate portions of interior surface 136 may receive different amounts or percentages of light from one of the light groups which causes those portions of interior surface 136 to reflect disproportionate amounts of light from a particular light group. These separate portions of interior surface 136 may create an observable pattern based on their relative distance to light groups 110 and 120, or based on their orientation relative to light groups 110 and 120.

For one example, a first portion of interior surface 136 adjacent light group 110 reflects a relatively large amount or percentage of light from light emitters 112, and a second portion of interior surface 136 adjacent light group 120 reflects a relatively large amount or percentage of light from light emitters 122. These different amounts may be measured in individual quantities, e.g., in intensity of light reflected from a particular light group, or in comparative quantities, e.g., in a ratio of light reflected from different light groups. In this example, the observer is capable of visually distinguishing light from the respective light groups based on the difference in appearance, e.g. the difference in spectral characteristics of light reflected by the portions of interior surface 136 under observation.

The portions of interior surface 136 which create the observable pattern of light reflection may be physically separated from each other, e.g., by a divider or gap, or may be separated from each other by an imaginary dividing line (e.g., a bifurcating line) across interior surface 136. In these examples, group 110 of light emitters 112 emits light through cavity 132 toward a first portion of interior surface 136, which reflect(s) the light from group 110, and group 120 of light emitters 122 emits light through cavity 132 toward a second, separate portion of interior surface 136, which reflect(s) the light from group 120. The separation between the first and second portions of interior surface 136 may serve to create a desired observable pattern of light reflection from reflector 130.

Controller 160 is coupled to control groups 110 and 120 of light emitters to emit light to provide general illumination of an area in the vicinity of lighting device 100. Controller 160 may independently control the operation of groups 110 and 120, or may jointly control the operation of groups 110 and 120.

Controller 160 is not required to perform any particular processing or functionality in the examples of lighting devices described. In some examples, controller 160 may operate simply by regulating a flow of energy to groups 110 and 120 of light emitters, either in a binary fashion (e.g., as an ON/OFF switch) or in a continuously or discretely (e.g., stepwise) fashion. However, in many examples, controller 160 may be capable of certain processing functions or algorithms to achieve additional functionality through the independent control and operation of groups 110 and 120 of light emitters in lighting device 100. Examples of such controllers are described below.

Figure 4:
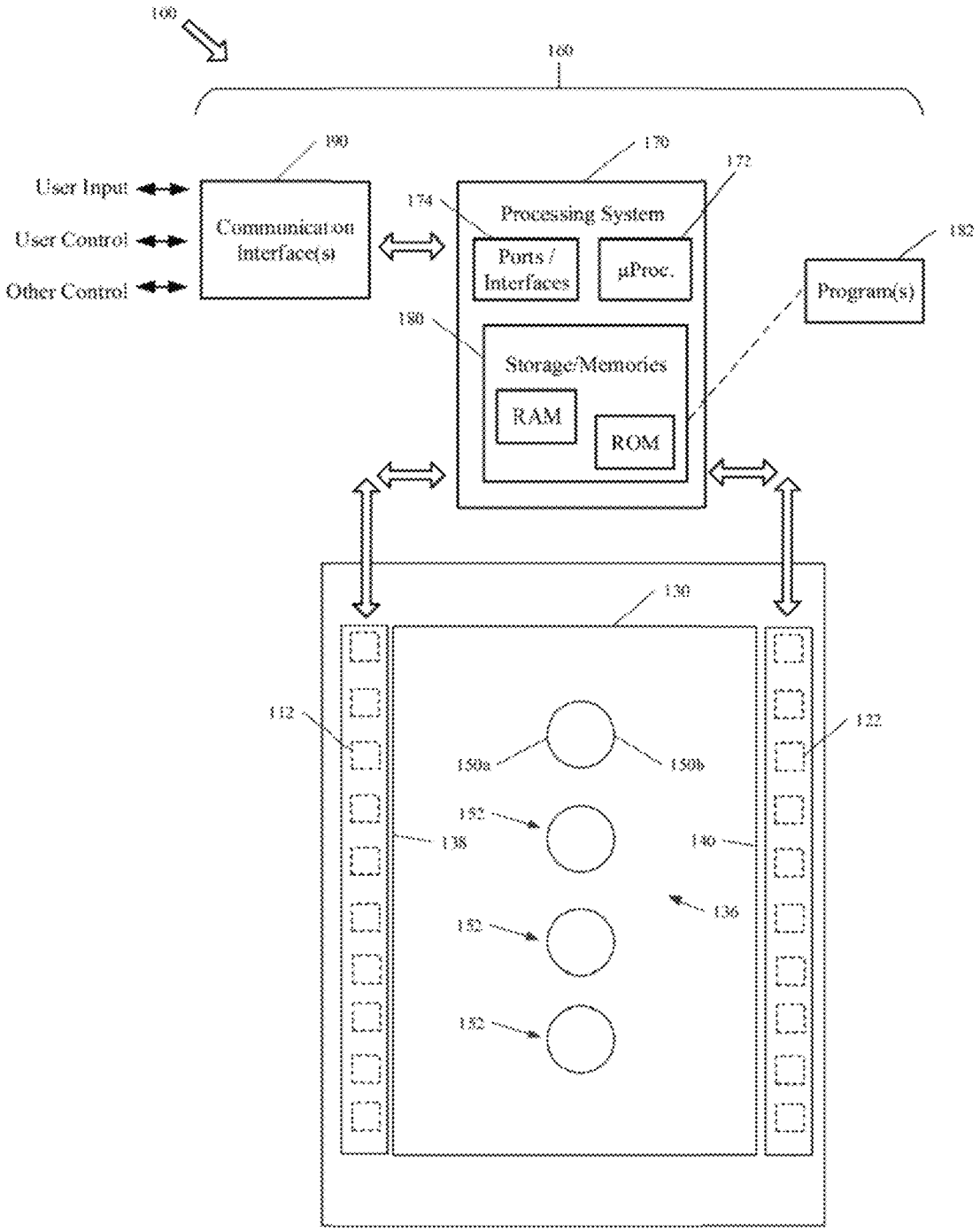
FIG. 4 is a high-level block diagram of a lighting device.

As a general overview, controller 160 may include a processing system 170, a memory 180, and one or more communication interfaces 190, as shown in FIG. 4.

Processing system 170 provides the high level logic or "brain" of lighting device 100. In one example, processing system 170 is coupled with communication interface(s) 190. Processing system 170 includes a central processing unit (CPU), shown by way of example as a microprocessor (μP) 172, although other processor hardware may serve as the CPU. Processing system 170 also includes memory 180, which may include a random access memory and/or a read-only memory, as desired.

Ports and/or interfaces 174 couple the microprocessor 172 to various other elements of the lighting device 100, such as groups 110 and 120 and/or communication interface(s) 190. For example, microprocessor 172 controls the emission of light from light emitters 112 and 122 via one or more of the ports and/or interfaces 174. In a similar fashion, one or more of the ports 174 enable microprocessor 172 of the processing system 170 to use and communicate externally via communication interface(s) 190. External communication by communication interface(s) 190, or communication within the internal components of lighting device 100, may be accomplished by any known manner of communication, including electrical communication, optical communication (such as visible light communication (VLC) or fiber optic communication), electromagnetic communications, or others.

Processing system 170 of controller 160 performs a number of functions for producing light for general illumination using groups 110 and 120. In a typical example, processing system 170 operates light emitters 112 of group 110 to emit light having a first value of a characteristic of emitted light, which is then reflected from a first feature 150*a* on the interior surface 136 of reflector 130, and is visible through opening 134 of reflective cavity 132. Independently, processing system 170 operates light emitters 122 of group 120 to emit light having a second value of the characteristic of emitted light different from the first value, which is then reflected from a second feature 150*b* on the interior surface 136 of reflector 130, and is visible through opening 134 of reflective cavity 132.

In another example, in which reflector 130 does not include reflective features 150, processing system 170 operates light emitters 112 of group 110 to emit light having a first value of a spectral characteristic of emitted light, which is then reflected from a first portion of the interior surface 136 of reflector 130, and is visible through opening 134 of reflective cavity 132. Independently, processing system 170 operates light emitters 122 of group 120 to emit light having a second value of the spectral characteristic of emitted light different from the first value, which is then reflected from a second portion of the interior surface 136 of reflector 130, and is visible through opening 134 of reflective cavity 132.

The difference between the values of the light emission characteristic emitted by the groups 110 and 120, and/or the difference between the manners in which features 150*a* and 150*b* reflect the light from groups 110 and 120, results in an observable pattern of light reflection on the interior surface 136 of reflector 130, in which the light from group 110 is visibly distinguishable from the light from group 120 to an observing viewing reflector 130 of lighting device 100. This observable pattern may create visual interest in the light device, or help to illustrate to an observer a dynamic or tunable functionality of the lighting device, where such functionality is present.

The formation of an observable pattern on reflector 130 does not preclude the use of lighting device 100 for general illumination. Processing system 170 may further control light emitters 112 and 122 such that the light from groups 110 and 120 which is reflected through opening 134 combines to produce white light having a predetermined intensity and color characteristic at a desired distance from opening 134. For example, processing system 170 may control the light emitters 112 and 122 to emit light which combines to form a white light having an intensity and color characteristic suitable for general illumination of the area in the vicinity of lighting device 100. As such, an observer viewing objects in the vicinity of lighting device 100 may not discern any pattern or spectral variance in the combination of light emitted from lighting device 100, and instead may only discern a pattern when viewing reflector 130 directly.

In some examples, processing system 170 may control groups 110 and/or 120 to emit light having different values of spectral characteristics. Processing system 170 may control the spectral characteristics of light emitted by groups 110 and 120 by controlling power to select ones of the light emitters in each group. For one example, each group 110 and 120 may include multiple light emitters, such as LEDs, adapted to emit light of a certain color, such as series of red, green, blue, and/or white LEDs. Processing system 170 may control the LEDs in group 110 to produce white light with a cool blue tint corresponding to a relatively high CCT, e.g., by providing power to a relatively higher number of the blue LEDs and a relatively lower number of the red LEDs. Conversely, processing system 170 may control the LEDs in group 120 to produce white light with a warm red tint corresponding to a relatively low CCT, e.g., by providing power to a relatively higher number of the red LEDs and a relatively lower number of the blue LEDs. Other example operations of processing system 170 which would control groups 110 and 120 to emit light having different values of spectral characteristics will be apparent, and may be selected based on the type and number of light emitters 112 and 122 provided in respective groups 110 and 120.

For another example, each group 110 and 120 may include multiple light emitters, such as LEDs, adapted to emit light of a certain CCT, such as series of relatively high CCT (e.g., 4,000K to 5,000K) LEDs and relatively low CCT (e.g., 2,700K-3,500K) LEDs. Processing system 170 may control the LEDs in group 110 to produce white light with a cool blue tint corresponding to a relatively high CCT, e.g., by providing more power to the high CCT LEDs. Conversely, processing system 170 may control the LEDs in group 120 to produce white light with a warm red tint corresponding to a relatively low CCT, e.g., by providing more power to the low CCT LEDs.

In some examples, processing system 170 may control groups 110 and/or 120 to emit light having different values of intensity. Processing system 170 may control the intensity of light emitted by groups 110 and 120 by controlling power to select ones of the light emitters in each group. For one example, each group 110 and 120 may include multiple light emitters, such as LEDs. Processing system 170 may provide a first amount of power to the LEDs in group 110 to produce light which when combined has a first intensity, and may provide a second, different amount of power to the LEDs in group 120 to produce light which when combined has a second, different intensity. Other example operations of processing system 170 which would control groups 110 and 120 to emit light having different values of intensity will be apparent, and may be selected based on the type and number of light emitters 112 and 122 provided in respective groups 110 and 120.

For another example, processing system 170 may control of the intensity of light emitted by groups 110 and 120 to change the apparent shape, size, directionality, or symmetry of lighting device 100. Processing system 170 may maintain a common intensity of light from light groups 110 and 120 to make lighting device 100 look symmetrical across any selected axis of reflector 130 or opening 134 (e.g., bilaterally or quadrilaterally symmetrical). Alternatively, processing system 170 may raise or lower the intensity of light from one of light groups 110 and 120 relative to the other, in order to make lighting device 100 look asymmetrical across any selected axis. Other visual effects achieved by adjusting the intensities of groups 110 and 120 will be apparent.

The control of groups 110 and 120 to emit light having different values of intensity does not preclude the use of lighting device 100 for general illumination. Processing system 170 may further control light emitters 112 and 122 such that the light from groups 110 and 120 which is reflected through opening 134 combines to maintain an overall level of intensity of light emitted by both groups 110 and 120. For example, processing system 170 may control group 110 of light emitters 112 to emit light having a value of intensity over a period of time. Over this same period of time, processing system 170 may control group 120 to adjust the intensity of light emitted by light emitters 122 to maintain an overall level of intensity of light emitted by groups 110 and 120, e.g., by increasing an intensity of light from group 120 such that the combined intensity of light from groups 110 and 120 remains at a predetermined value or within a predetermined range. Processing system 170 may control groups 110 and 120 to maintain a level of illumination or light intensity within a predetermined range of a set intensity, e.g., within ±10% of a predetermined or set intensity, in order to prevent disruption of the primary function of illumination provided by the lighting device.

Changes in lighting characteristics over time may be performed continuously, e.g., at a predetermine rate of change of a value of the lighting characteristics, such as a predetermining rate of raising or lowering lighting intensity. Alternatively, changes in lighting characteristics may be performed in a periodic or stepwise fashion, with changes occurring at predetermined intervals of time, e.g., every hour. Changes in lighting characteristics may also be performed according to a predefined schedule, or based on user input and/or sensor input.

Processing system 170 is not limited to changing intensity over time, but may also adjust spectral characteristics over time in a similar fashion. For another example, processing system 170 may control group 110 of light emitters 112 to emit light having a chromaticity that changes in hue over a period of time, e.g., by lowering or turning off green light emitters in group 110. Over this same period of time, processing system 170 may control group 120 to adjust the chromaticity of light emitted by light emitters 122 to maintain an overall chromaticity of light emitted by groups 110 and 120, e.g., by raising or turning on green light emitters in group 120 such that the combined chromaticity of light from groups 110 and 120 remains at a predetermined value or within a predetermined range. Processing system 170 may control groups 110 and 120 to maintain a color characteristic within a predetermined range of a set intensity, e.g., within a CCT and/or color rendering index (CRI) within ±10% of a predetermined or set CCT or CRI, in order to prevent disruption of the primary function of illumination provided by the lighting device. From the above examples, it will be understood that controller 160 is not limited to varying either spectral or non-spectral characteristics at a time, but may vary both simultaneously, as desired.

The above operations of processing system 170 may be automatic or may be responsive to human input. As used herein, the "automatic" action of processing system 170 is one that is not performed in response to a signal or instruction from a human operator. Processing system 170 may control the light emitted by groups 110 and 120 according to the instructions of one or more programs 182 stored in memory 180. Alternatively, instructions for controlling groups 110 and 120 with controller 160 may be received from a remote location by processing system 170 via communications interface(s) 190. In one example, communication interface(s) 190 incorporates a wired or wireless transceiver that provides a connection to a remote location, such as an external controller or one or more other lighting devices. Processing system 170 receives instructions for controlling groups 110 and 120 using the transceiver of communication interface 190. These instructions may be received from other lighting devices (where a system of lighting devices is provided) and/or from a central location provided for controlling a system of lighting devices.

Devices that implement functions like those of lighting device 100 may take various forms. In some examples, some components attributed to the lighting device 100 may be separated from groups 110 and 120 and reflector 130 For example, an apparatus may have all of the above hardware components on a single hardware device as shown in FIGS. 1A and 1B, or in different, somewhat separate units. In a particular example, one set of the hardware components may be separated from groups 110 and 120 and reflector 130, such that the controller 160 may run a system of light emitter group/reflector combinations from a remote location. Also, one set of intelligent components, such as microprocessor 172, may control/drive some number of groups 110 and 120 (via communication interfaces 190 on each lighting device 100). It also is envisioned that some lighting devices may not include or be coupled to all of the illustrated elements, such as the communication interface(s) 190.

Lighting device 100 may be used as a standalone lighting device or as part of a system of lighting devices. In one example, a system of lighting devices is provided with each lighting device including the components described above for lighting device 100. It will be understood that such a system could include any number of lighting devices as desired to adequately illuminate the region in which the system is located.

In such a system, the lighting devices may coordinate the control of their respective light groups to create an observable pattern of light reflection produced on the reflectors of multiple light devices across an entire region under illumination. The control of spectral and non-spectral characteristics may be performed substantially as described at each of the respective light devices. This control may be performed by respective controllers of the light devices, or instructions may be transmitted to the light devices from a central controller via respective communications interfaces of the light devices. Such communication between the lighting devices and the central controller may be made wirelessly or over wires, depending on the form of the communication interface.

Aspects of methods of controlling groups of light emitters using the lighting devices outlined above may be embodied in programming, for a server computer, a user terminal client device and/or the lighting devices themselves. Such programming may contain instructions for performing the functions recited above, including control of light emitters and the adjustments to characteristics of light emitted by the light emitters. Program aspects of the technology may be thought of as "products" or "articles of manufacture" typically in the form of executable code and/or associated data (e.g. configuration information and/or files containing such information) that is carried on or embodied in a type of machine readable medium. "Storage" type media include any or all of the tangible memory of the lighting devices, computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the configuration information and/or applicable programming from one device, computer or processor into another, for example, from a management server or host computer of the store service provider into the computer platform and/or from that store equipment into a particular lighting device, or vice versa. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software, e.g. the programming and/or data. As used herein, unless restricted to non-transitory, tangible "storage" media, terms such as computer or machine "readable medium" refer to any medium that participates in providing instructions to a processor or the like for execution or in providing data (e.g. configuration information) to a processor or the like for data processing.

Hence, a machine readable medium may take many forms, including but not limited to, a non-transitory or tangible storage medium, a carrier wave medium or physical transmission medium. Non-volatile storage media include, for example, optical or magnetic disks, such as any of the storage devices in any computer(s) or the like, such as may be used to implement the image processing functions of the lighting device, or the store server, or the user terminals, etc. shown in the drawings. Volatile storage media include dynamic memory, such as main memory of such a computer platform or other processor controlled device. Tangible transmission media include coaxial cables; copper wire and fiber optics, including the wires that comprise a bus within a computer system or the like. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer or other machine can read programming code and/or data. Many of these forms of computer readable media may be involved in carrying one or more sequences of one or more instructions to a processor for execution.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A lighting device, comprising:

a reflector defining a reflective cavity having an opening, an interior surface of the reflective cavity comprising:

at least one first feature adapted to reflect light in a first manner; and at least one second feature adapted to reflect light in a second manner different from the first manner;

a first group of controllable light emitters positioned along a first edge of the opening of the reflective cavity to emit light away from the opening of the reflective cavity through the reflective cavity toward the at least one first feature;

a second group of controllable light emitters positioned along a second edge of the opening of the reflective cavity separate from the first edge to emit light away from the opening of the reflective cavity through the reflective cavity toward the at least one second feature;

a controller coupled to the first and second groups of light emitters, the controller being configured to:

control the first group of emitters to emit light having a first value of a characteristic of emitted light reflected from the at least one first feature and visible through the opening of the reflective cavity; and control the second group of emitters to emit light having a second value of the characteristic of emitted light reflected from the at least one second feature and visible through the opening of the reflective cavity, the second value being different from the first value, wherein the controller controls the first and second groups of emitters to create patterns of reflection of light having visibly different characteristics to an observer looking at the reflector.

2. The lighting device of claim 1, wherein the first and second groups of light emitters comprise light emitting diodes.

3. The lighting device of claim 1, wherein the characteristic of emitted light is a spectral characteristic.

4. The lighting device of claim 3, wherein the spectral characteristic is correlated color temperature.

5. The lighting device of claim 1, wherein the opening of the reflective cavity has a rectilinear shape including opposed first and second edges, and the first group of light emitters is positioned along the first edge of the opening of the reflective cavity, and the second group of one or more light emitters is positioned along the second edge of the opening of the reflective cavity.

6. The lighting device of claim 1, wherein the at least one first feature is adapted to reflect light in a first direction, and the at least one second feature is adapted to reflect light in a second direction different from the first direction.

7. The lighting device of claim 6, wherein the interior surface of the reflective cavity comprises at least one projection or indent, and wherein the at least one first feature is formed as a first side of the at least one projection or indent, and the at least one second feature is formed as a second side of the at least one projection or indent.

8. The lighting device of claim 7, wherein the at least one projection or indent comprises a plurality of projections or indents arranged in a pattern on the interior surface of the reflective cavity.

9. The lighting device of claim 7, wherein the at least one projection or indent comprises a plurality of projections or indents arranged in a disorganized fashion on the interior surface of the reflective cavity.

10. The lighting device of claim 1, wherein the at least one first feature has a first reflectance, and the at least one second feature has a second reflectance different from the first reflectance.

11. The lighting device of claim 1, wherein the at least one first feature is adapted to reflect light with a first diffusion, and the at least one second feature is adapted to reflect light with a second diffusion different from the first diffusion.

12. The lighting device of claim 1, wherein the characteristic of emitted light is intensity.

13. The lighting device of claim 12, wherein the controller is further configured to adjust the intensity of the light emitted by at least one of the first and second groups over time while maintaining an overall level of intensity of light emitted by the lighting device.

14. The lighting device of claim 1, wherein the controller is further configured to control the first and second groups of emitters to achieve a combined white light at a distance from the opening of the reflective cavity of predetermined intensity and color characteristic.

15. The lighting device of claim 1, wherein:

the first edge of the opening comprises a first support having a surface facing away from the opening, the first group of light emitters mounted to the surface of the first support facing away from the opening; and the second edge of the opening comprises a second support having a second support having a surface facing away from the opening, the second group of light emitters mounted to the surface of the second support facing away from the opening.

16. A lighting device, comprising:

a reflector defining a reflective cavity having an interior surface and an opening;

a first group of controllable light emitters positioned along a first edge of the opening of the reflective cavity to emit light away from the opening of the reflective cavity through the reflective cavity toward a first portion of the interior surface;

a second group of controllable light emitters positioned along a second edge of the opening of the reflective cavity separate from the first portion to emit light away from the opening of the reflective cavity through the reflective cavity toward a second portion of the interior surface different from the first portion;

a controller coupled to the first and second groups of light emitters, the controller being configured to:

control the first group of emitters to emit light having a first value of a spectral characteristic of emitted light reflected from the first portion of the interior surface and visible through the opening of the reflective cavity; and control the second group of emitters to emit light having a second value of the spectral characteristic of emitted light reflected from the second portion of the interior surface and visible through the opening of the reflective cavity, the second value being different from the first value, wherein the controller controls the first and second groups of emitters to create patterns of reflection of light having visibly different characteristics to an observer looking at the reflector such that the pattern of reflection of light from the first portion of the interior surface is visibly distinguishable to the observer from the pattern of reflection of light from the second portion of the interior surface.

17. The lighting device of claim 16, wherein the first and second groups of light emitters comprise light emitting diodes.

18. The lighting device of claim 16, wherein the spectral characteristic is correlated color temperatures.

19. The lighting device of claim 16, wherein the opening of the reflective cavity has a rectilinear shape including opposed first and second edges, and the first group of light emitters is positioned along the first edge of the opening of the reflective cavity, and the second group of light emitters is positioned along the second edge of the opening of the reflective cavity.

20. The lighting device of claim 16, wherein the controller is further configured to control the first and second groups of emitters to achieve a combined white light at a distance from the opening of the reflective cavity of predetermined intensity and color characteristic.

21. A method comprising:

emitting light from a first group of controllable light emitters positioned along a first edge of an opening of a reflective cavity of a reflector through the reflective cavity, an interior surface of the reflective cavity comprising at least one first feature adapted to reflect light in a first manner, and at least one second feature adapted to reflect light in a second manner different from the first manner, the first group emitting light away from the opening of the reflective cavity toward the at least one first feature;

emitting light from a second group of controllable light emitters positioned along a second edge of the opening of the reflective cavity separate from the first portion through the reflective cavity away from the opening of the reflective cavity toward the at least one second feature;

controlling the first group of emitters to emit light having a first value of a characteristic of emitted light reflected from the at least one first feature and visible through an opening of the reflective cavity; and controlling the second group of emitters to emit light having a second value of the characteristic of emitted light reflected from the at least one second feature and visible through the opening of the reflective cavity, the second value being different from the first value, wherein the controlling includes controlling the first and second groups of emitters to create patterns of reflection of light having visibly different characteristics to an observer looking at the reflector.

22. The method of claim 21, wherein the characteristic of emitted light is a spectral characteristic.

23. The method of claim 21, wherein the characteristic of emitted light is intensity.

24. The method of claim 23, further comprising adjusting the intensity of the light emitted by at least one of the first and second groups over time while maintaining an overall level of intensity of light emitted by the lighting device.

25. The method of claim 21, further comprising controlling the first and second groups of emitters to achieve a combined white light at a distance from the opening of the cavity of predetermined intensity and color characteristic.

26. A method comprising:

emitting light from a first group of controllable light emitters positioned along a first edge of an opening of a reflective cavity of a reflector away from the opening of the reflective cavity toward a first portion of an interior surface of the reflective cavity;

emitting light from a second group of controllable light emitters positioned along a second edge of the opening of the reflective cavity separate from the first portion away from the opening of the reflective cavity toward a second portion of the interior surface of the reflective cavity, the second portion of the interior surface separate from the first portion;

controlling the first group of emitters to emit light having a first value of a spectral characteristic of emitted light reflected from the first portion of the interior surface and visible through the opening of the reflective cavity; and controlling the second group of emitters to emit light having a second value of the spectral characteristic of emitted light reflected from the second portion of the interior surface and visible through the opening of the reflective cavity, the second value being different from the first value, wherein the controlling includes controlling the first and second groups of emitters to create patterns of reflection of light having visibly different characteristics to an observer looking at the reflector.

27. The method of claim 26, wherein the spectral characteristic of emitted light is correlated color temperature.

28. The method of claim 26, further comprising controlling the first and second groups of emitters to achieve a combined white light at a distance from the opening of the cavity of predetermined intensity and color characteristic.

29. A lighting device, comprising:

a reflector defining a reflective cavity having an interior surface and an opening;

a first group of controllable light emitters positioned along a first edge of the opening of the reflective cavity to emit light through the reflective cavity away from the opening of the reflective cavity toward a first portion of the interior surface;

a second group of controllable light emitters positioned along a second edge of the opening of the reflective cavity separate from the first portion to emit light through the reflective cavity away from the opening of the reflective cavity toward a second portion of the interior surface different from the first portion;

a controller coupled to the first and second groups of light emitters, the controller being configured to:

control the first group of emitters to emit light having a first value of intensity reflected from the first portion of the interior surface and visible through the opening of the reflective cavity;

control the second group of emitters to emit light having a second value of intensity reflected from the second portion of the interior surface and visible through the opening of the reflective cavity, the second value being different from the first value, wherein the controller controls the first and second groups of emitters to create patterns of reflection of light having visibly different characteristics to an observer looking at the reflector such that the pattern of reflection of light from the first portion of the interior surface is visibly distinguishable to the observer from the pattern of reflection of light from the second portion of the interior surface; and adjust the intensity of the light emitted by at least one of the first and second groups over time while maintaining an overall level of intensity of light emitted by the lighting device.

30. A lighting device, comprising:

a reflector defining a reflective cavity having an opening and an interior surface of the reflective cavity comprising:

at least one first feature adapted to reflect light, received from a first direction, out through the opening; and at least one second feature adapted to reflect light, received from a second direction different from the first direction, out through the opening;

a first group of controllable light emitters positioned along a first portion of a periphery of the opening of the reflective cavity to emit light away from the opening of the reflective cavity and from the first direction through the reflective cavity toward the at least one first feature;

a second group of controllable light emitters positioned along a second portion of the periphery of the opening of the reflective cavity separate from the first portion to emit light away from the opening of the reflective cavity and from the second direction through the reflective cavity toward the at least one second feature;

a controller coupled to the first and second groups of light emitter's, the controller being configured to:

in a first state, control the first group of emitters to emit light having a first value of a characteristic of emitted light reflected from the at least one first feature and visible through the opening of the reflective cavity to optically emphasize the at least one first feature; and in a second state, control the second group of emitters to emit light having a second value of the characteristic of emitted light reflected from the at least one second feature and visible through the opening of the reflective cavity, the second value being different from the first value, to optically emphasize the at least one second feature instead of the at least one first feature.

* * * * *